US005911801A

United States Patent [19]

Fravalo et al.

[11] Patent Number: 5,911,801

[45] Date of Patent: Jun. 15, 1999

[54] TORQUE WRENCH

[75] Inventors: Rene Michel Fravalo, Chally En Biere; Ludovic Henri-Georges Regnier, Argentieres, both of France

[73] Assignee: FACOM, Morangis Cedex, France

[21] Appl. No.: 08/978,485

[22] Filed: Nov. 25, 1997

[30] Foreign Application Priority Data

Nov. 27, 1996 [FR] France ..... 96 14547

[51] Int. Cl.[6] ..... B25B 23/142

[52] U.S. Cl. ..... 81/478; 384/58; 73/862.23

[58] Field of Search ..... 81/478, 483; 74/527; 384/58; 73/862.23

[56] References Cited

U.S. PATENT DOCUMENTS 2,887,919 5/1959 Aijala .
2,897,704 8/1959 Woods .
2,959,078 11/1960 Skidmore .
3,633,445 1/1972 Aijala .
5,129,293 7/1992 Larson et al. .
5,244,284 9/1993 Larson et al. .
5,503,042 4/1996 Larson et al. .

FOREIGN PATENT DOCUMENTS 819 828 11/1951 Germany .

*Primary Examiner*—James G. Smith
*Attorney, Agent, or Firm*—Wenderoth, Lind & Ponack, L.L.P.

[57] ABSTRACT

This wrench comprises an outer body (2) of elongate shape in which the head (1) of the wrench is articulated about a pivot (12); a plunger (3) that can move axially in the outer body and is urged towards the head by a preloaded spring (4); and at least a first rolling body (22) intended to reduce friction as the plunger moves. The rolling body (22) is a cylindrical roundel whose peripheral surface rolls on the one hand along a first flat track (16) secured to the outer body and which is pressed against this track when torque is applied, and on the other hand along a second flat track (20) formed on the plunger.

11 Claims, 6 Drawing Sheets

X
II
IV
F
P
L
1
2
3
4
5
6
7
8
9
10
11
12
13
14
15
16
17
18
19
22
23
24
25
33
34
35
35A
36
116
117

TORQUE WRENCH

The present invention relates to a torque wrench, of the type comprising an outer body of elongate shape in which the head of the wrench is articulated about a pivot; a plunger that can move axially in the outer body and is urged towards the head by a preloaded spring; at least a first rolling body intended to reduce friction as the plunger moves, this rolling body comprising a peripheral surface which rolls along a first track secured to the outer body and which is pressed against this track when torque is applied; and a load-transmission member inserted between the front end of the plunger and the rear end of the head.

The invention applies to so-called "break-action" wrenches, in which, when a predetermined applied torque is reached, the outer body becomes angularly offset from the head by a relatively large and visible angle. It also applies to so-called "disengaging-action" wrenches, in which, under the same conditions, the outer body becomes offset only by a small angle, the user essentially being alerted by a shock between two metal components that maximum torque has been reached.

To improve the accuracy with which the disengagement torque can be set during calibration and over time, a known practice is to make the axial movement of the plunger easier using one or more rolling bodies. Documents U.S. Pat. Nos. 2,897,704, 5,503,042 and 5,244,284 are examples of this technology.

However, in each of the abovementioned documents, the rolling bodies are rollers extended by pins, which are accommodated in housings (orifices or slots) in the plunger. This leads to substantial amounts of friction between these pins and their housings when the plunger moves, and this detracts from the accuracy of the disengagement torque.

Another known practice (U.S. Pat. Nos. 3,633,445 and 2,887,919) is to insert a ball race between the plunger and outer body. The drawback of an arrangement of this kind lies in the low capacity of the tool and in its mediocre mechanical integrity over time, because of the point contacts between the balls and the surfaces along which they run.

The object of the invention is to provide, in an economical way, improved accuracy and better reproducibility of the disengagement torque.

To achieve this, the subject of the invention is a torque wrench of the aforementioned type, characterized in that the rolling body is a cylindrical roundel whose peripheral surface also rolls along a second track formed on the plunger, and in that each track is flat.

Embodiments of the invention will now be described with reference to the appended drawings in which.

Figures 1, 2, 3:
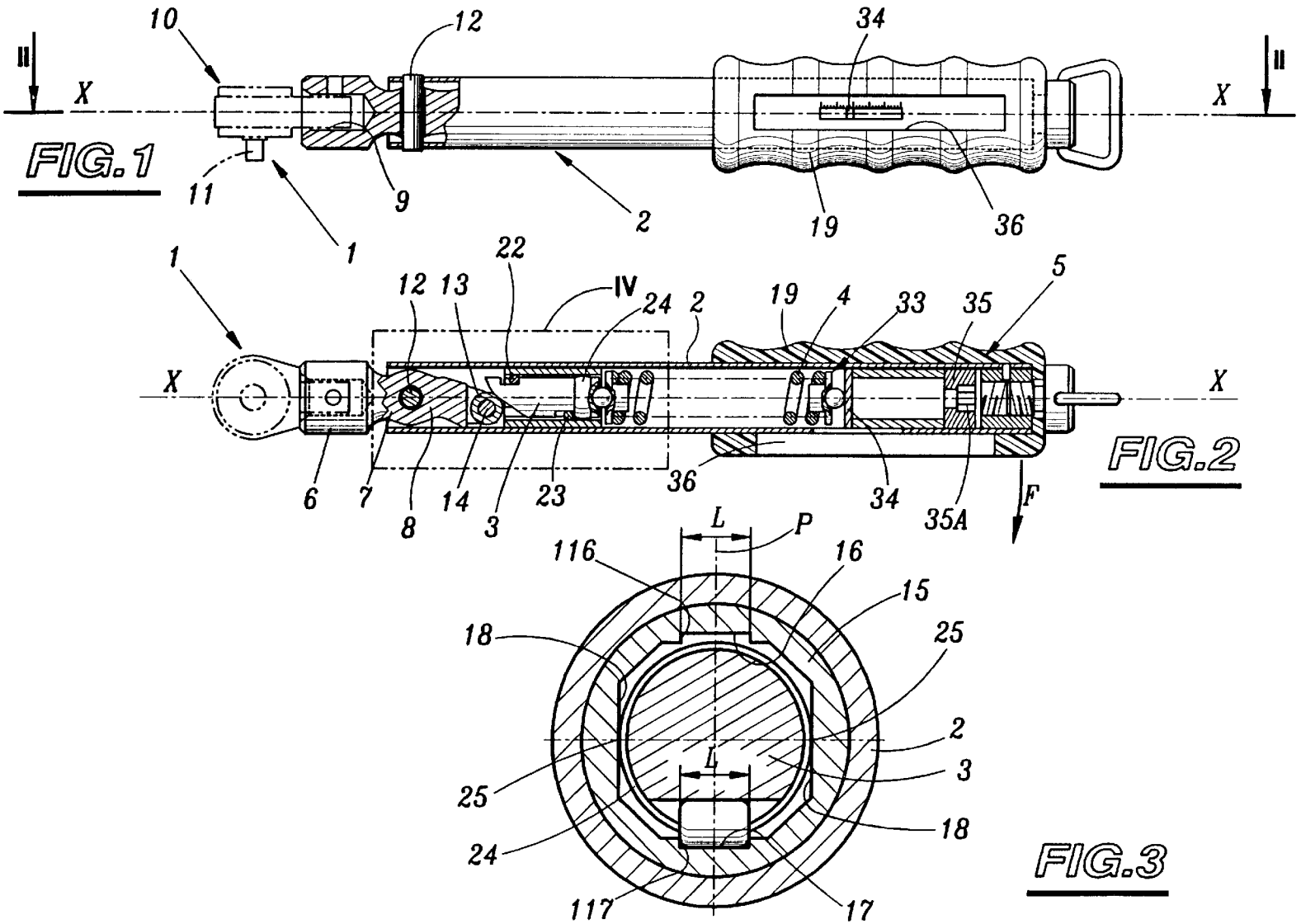
FIG. 1 is a view from above, with partial section, of a break-action wrench in accordance with the invention.
FIG. 2 is a sectional side view, the section being taken on the line II—II of FIG. 1.
FIG. 3 is a view in cross section taken on the line III—III of FIG. 4.
Figure 4:
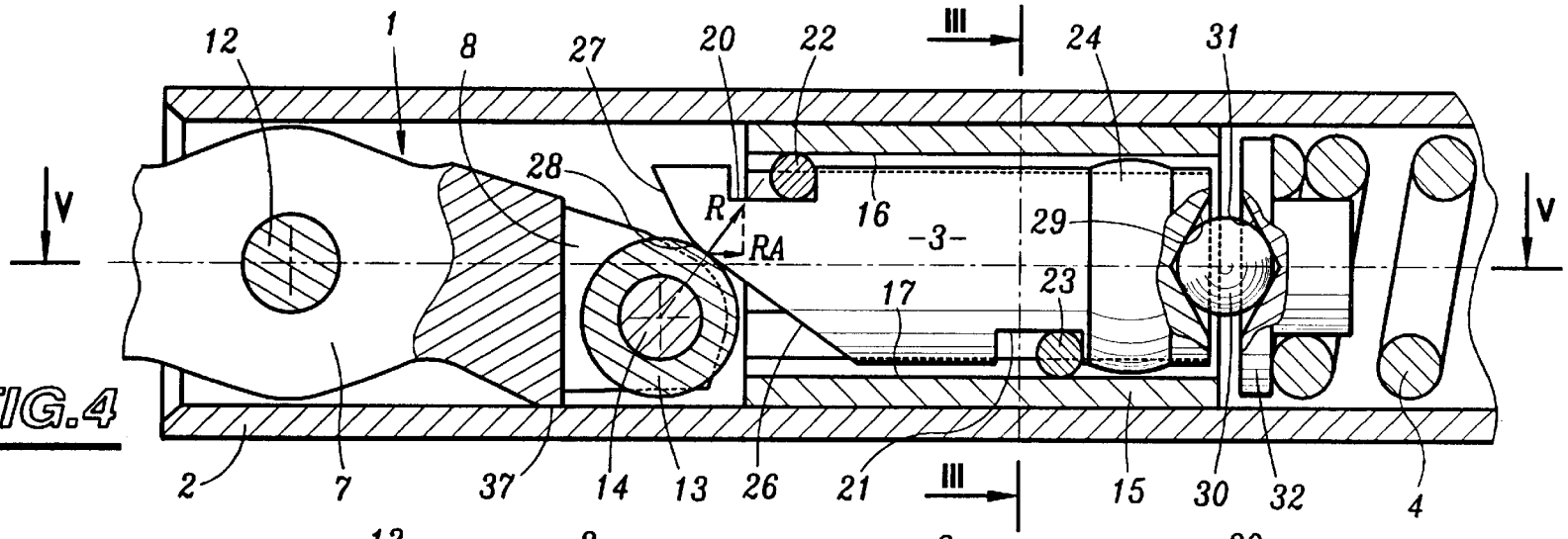
FIG. 4 is a sectional side view, on a larger scale, of region IV of FIG. 2.
Figure 5:
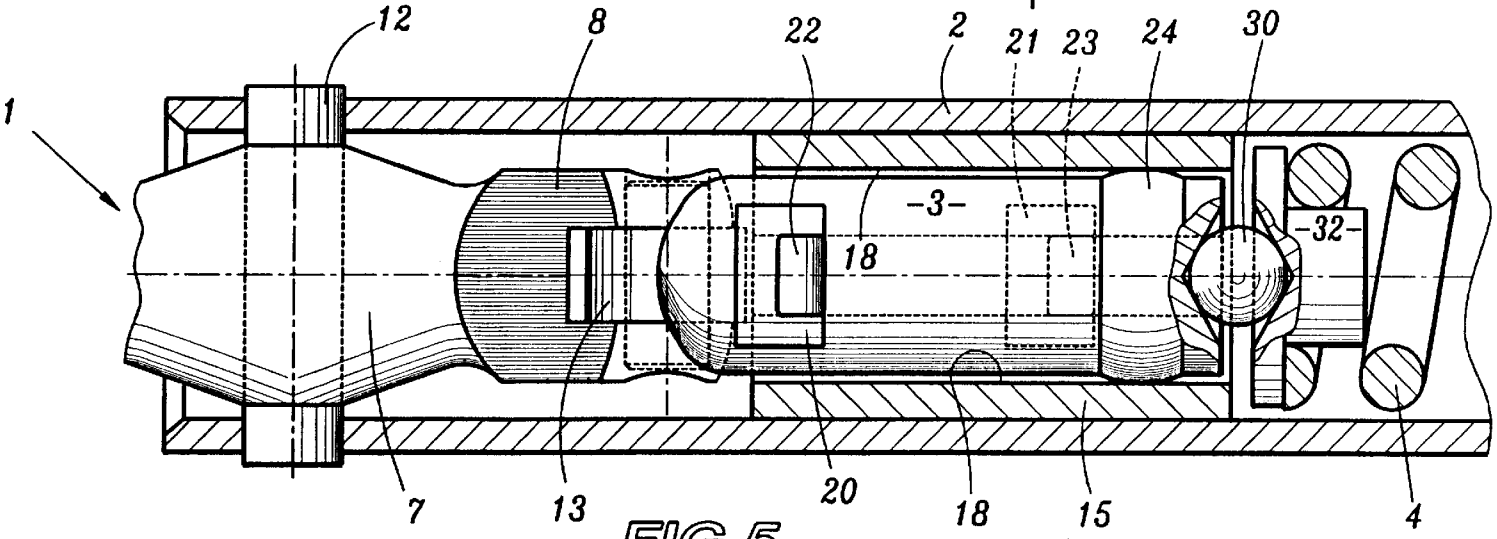
FIG. 5 is a view from above, partly in section on the line V—V of FIG. 4.

The break-action wrench in FIGS. 1 to 5 essentially comprises a head 1, a tubular outer body 2 of circular section, a plunger 3, a preloaded coil spring 4 and an adjusting mechanism 5. The tool as a whole has an overall axis X—X.

The head 1 is a component which has a front block 6, an intermediate articulation region 7 and a rear shank 8. The block 6, starting from its front end, has a blind bore 9, in which an operating device 10 fits and is fixed. The latter is typically a ratchet head that can be reversed by turning it round, with a driving square 11 onto which a tightening socket (not depicted) can be fitted.

The region 7 of the head 1 pivots on a pivot 12 which passes diametrically through the body 2 and is secured thereto. The rear end of the shank 8 is forked and has a cylindrical roller 13 which pivots on a pivot 14 parallel to the pivot 12.

For the convenience of the description, it will be assumed that the pivot 12 is horizontal, as depicted in FIG. 2, and that the overall axis X—X is horizontal also. This corresponds to operations on a screw or nut (not depicted) with a horizontal axis. It will also be assumed that this threaded component is being tightened by lowering the right-hand end of the body 2, in the direction of the arrow F in FIG. 2.

A slideway 15 of tubular overall shape is fixed in an intermediate region of the body 2. This slideway defines a flat and horizontal upper track 16 and a flat and horizontal lower track 17 (FIG. 3). These two tracks which, in this example, have the same width L, are symmetric with respect to the vertical mid-plane P and are delimited laterally by side walls 116, 117, respectively, which are parallel to the plane P. The slideway also defines two lateral faces 18 facing each other, these also being parallel to the plane P.

A plastic handgrip 19 is fixed to the back part of the body 2.

The plunger 3 has a cylindrical overall section designed to slide with clearance in the slideway 15. In its front part, a recess forms a flat and horizontal upper track 20 parallel to the pivots 12 and 14. To the rear of this track 20, and on the opposite side with respect to the axis X—X, the plunger has a second recess which defines a second flat and horizontal track 21 parallel to the previous one. The track 20 faces the track 16 of the slideway, and the track 21 faces the track 17.

A front cylindrical roundel 22 is inserted between the tracks 16 and 20, and a rear cylindrical roundel 23 is inserted between the tracks 17 and 21. In this example, the two roundels have the same diameter. They also have a length L so that they can be guided between the side walls 116, 117 of the two tracks.

At its rear end, just behind the track 21, the plunger has a spherical domed region 24 which (FIG. 3) is in contact via two diametrically opposed points 25, with the lateral faces 18 of the slideway.

At its front end, the plunger has a cam with horizontal and transverse generatrices, formed by two successive ramps 26 and 27. The lower ramp 26 has a relatively gradual slope, for example of the order of 35°, while the upper ramp 27 has a markedly steeper slope, for example of the order of 70°. These slopes are measured with respect to the axis X—X.

The two ramps are connected by a rounded portion 28 which meets them tangentially and the centre of which is almost mid-way along the track 20 and level, in the radial sense, with the centre of the roundel 22.

The rear face of the plunger 3 is vertical and has a central conical recess 29 cut in it. A ball 30 rests in this recess and in a conical recess 31 situated opposite made in the front face of an adapter piece 32 secured to the front end of the spring 4.

A similar adapter piece/ball assembly 33 is provided at the rear end of the spring 4, and a vertical plate 34 which forms part of the adjustment mechanism 5 rests against the ball. This adjustment mechanism is conventional and comprises a screw/nut system the screw 35 of which is operated by a hexagon socket head 35A. The disengagement torque thus set, defined by the compression of the spring 4 which corresponds to the position of the plate 34 is displayed on an appropriate graduation on the body 2, visible through an opening 36 in the handgrip 19, as depicted diagrammatically in FIG. 1.

The way in which the break-action wrench thus described works is as follows.

At rest (FIGS. 4 and 5), the roller 13 rests on the upper region of the lower ramp 26, close to the rounded portion 28, and the shank 8 is in abutment at 37 against the lower region of the body 2. In addition, each roundel 22, 23 is close to the rear end of the associated track 20, 21.

Figure 6:
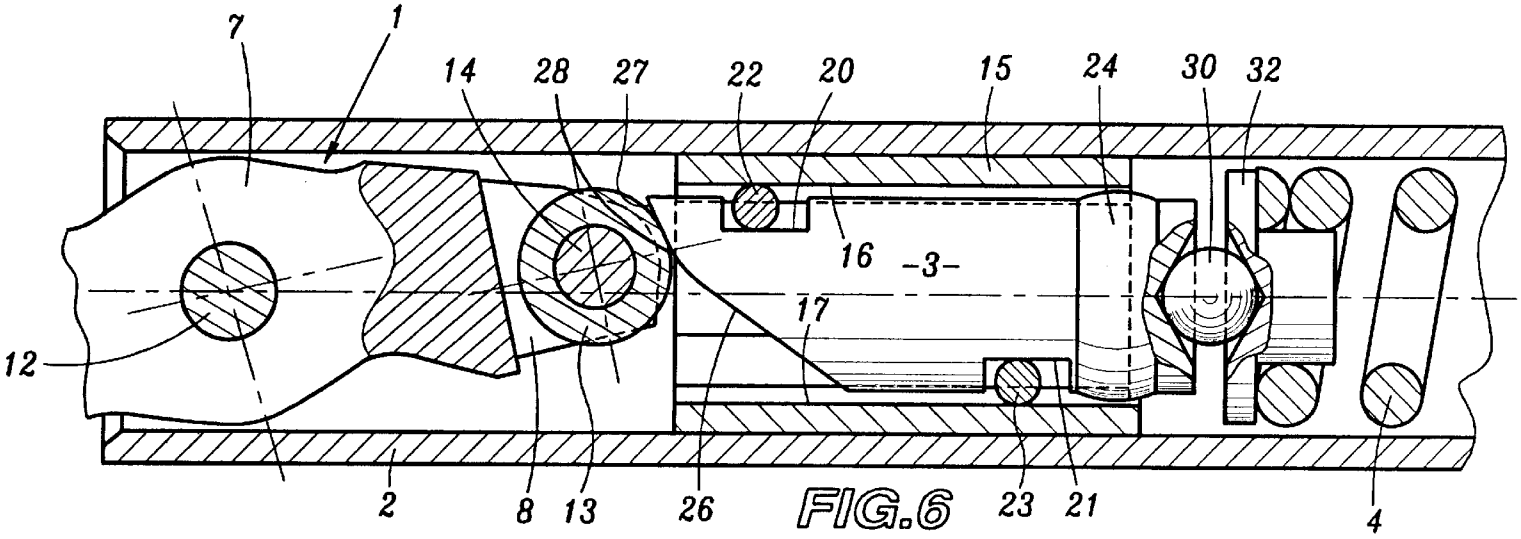
FIGS. 6 and 7 are views similar to FIG. 4, respectively illustrating two successive phases in the operation of the wrench.
Figure 7:
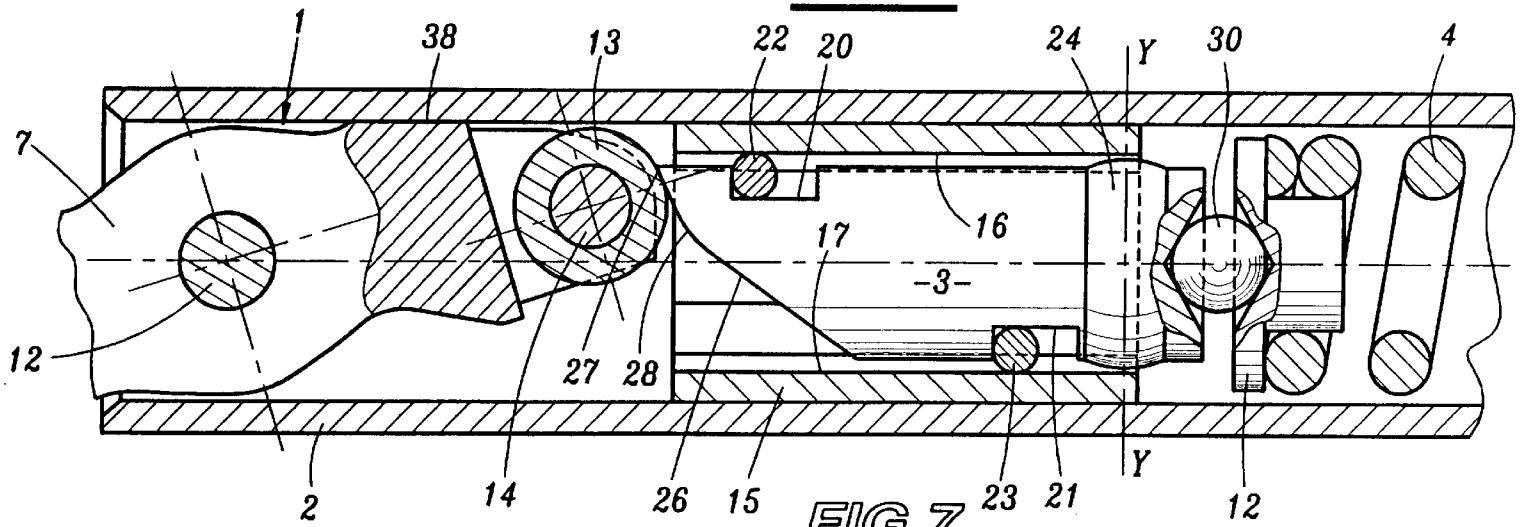

When a force is applied to the handgrip 19 in the direction of the arrow F of FIG. 2, the roller 13 exerts on the plunger 3 a radial reaction R which has an axial component RA directed backwards. When, as the force increases, this axial component balances the force of the spring 4, the plunger begins to move back so that the roller 13 starts to roll over the rounded portion 28 (FIG. 6) then along the upper ramp 27 (FIG. 7) until the shank 8 comes, at 38, against the upper region of the body 2.

Because the slope of the cam 26 increases at 28 as soon as the roller comes onto the rounded portion 28, the torque decreases as soon as the maximum torque predetermined by the setting of the tool is reached. However, thanks to the slope of the upper ramp 27, the torque does not disappear sharply, which would be dangerous. The shock that may occur, at 38, (FIG. 7) between the shank 8 and body 2 indicates that the maximum breakage of the wrench has been achieved. The tracks 20 and 21 are dimensioned in such a way that the roundels are then close to the front end of these tracks.

The reaction R always passes close to the roundel 22, which means that this roundel transmits the load to the associated track 16. Thanks to the fact that the roundel rolls both on this track 16 and on the track 20 of the plunger, only a resistance to rolling is to be overcome, and this means that the plunger is guaranteed particularly good freedom to move. A great deal of precision in the setting of the disengagement torque, good stability of this torque over time, and good reproducibility of performance from one tool to another can thus be achieved.

The roundels are cylindrical and well guided by the interaction of their end faces with the vertical side walls 116, 117 of the tracks 16 and 17. For that, the depth of the corresponding recesses is similar to the radius of the roundels. It then follows that linear contact between each roundel and the associated tracks is maintained, and that the contact pressures are therefore relatively low, which reduces wear over time.

In addition, the tracks 20 and 21 are formed over the entire width of the corresponding chords of the cross section of the plunger (FIG. 3) and are wider than the tracks 16 and 17. The result of this is that the plunger has a certain freedom for horizontal movement by rotating about a vertical axis Y—Y which passes through the centre of the spherical region 24, guidance being provided by the two lateral contacts 25 (FIG. 3). This ensures that the plunger self-aligns with respect to the roller 13, and therefore guarantees linear contact, with low contact pressure, between this roller and the cam 26 to 28.

Figure 8:
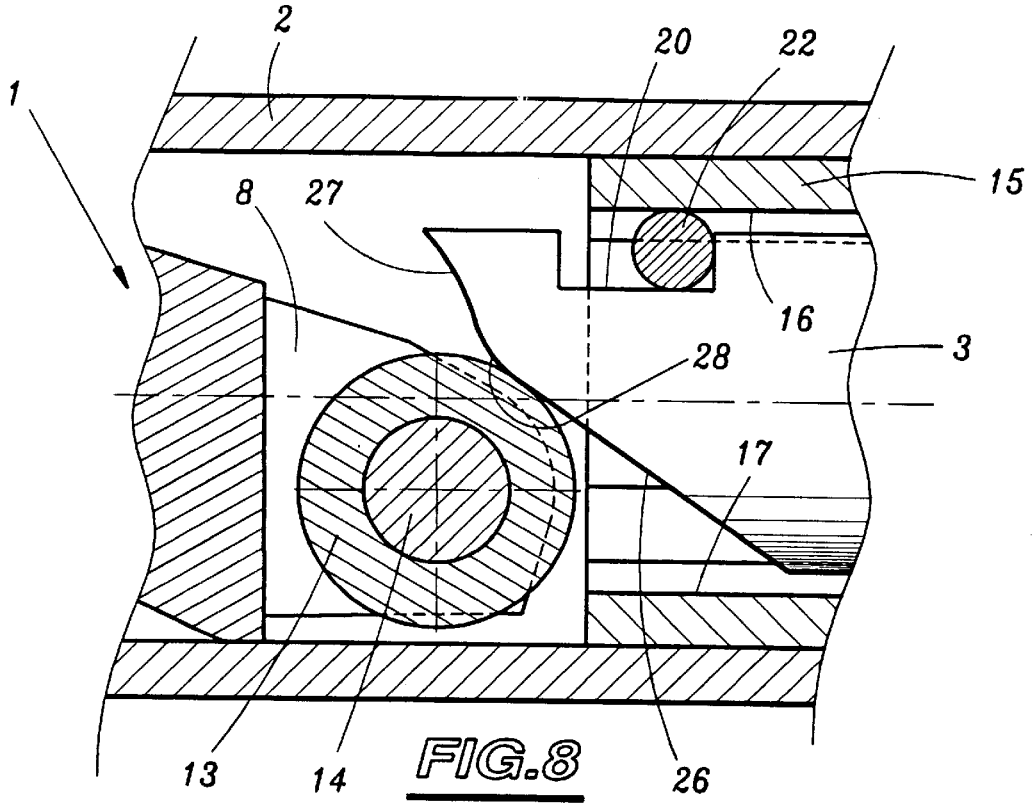
FIGS. 8 and 9 are part views similar to FIG. 4 of two alternative forms.
Figure 9:
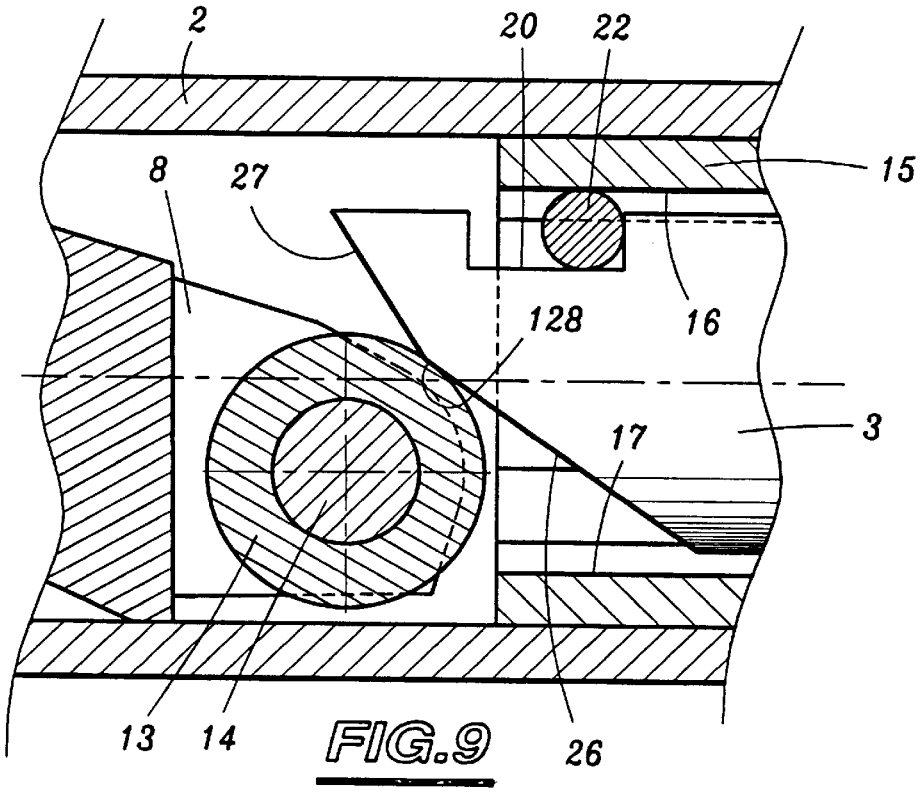

As an alternative, the upper ramp 27 may be concave (FIG. 8) and/or meet the ramp 26 at a sharp edge 128 (FIG. 9).

Figure 10:
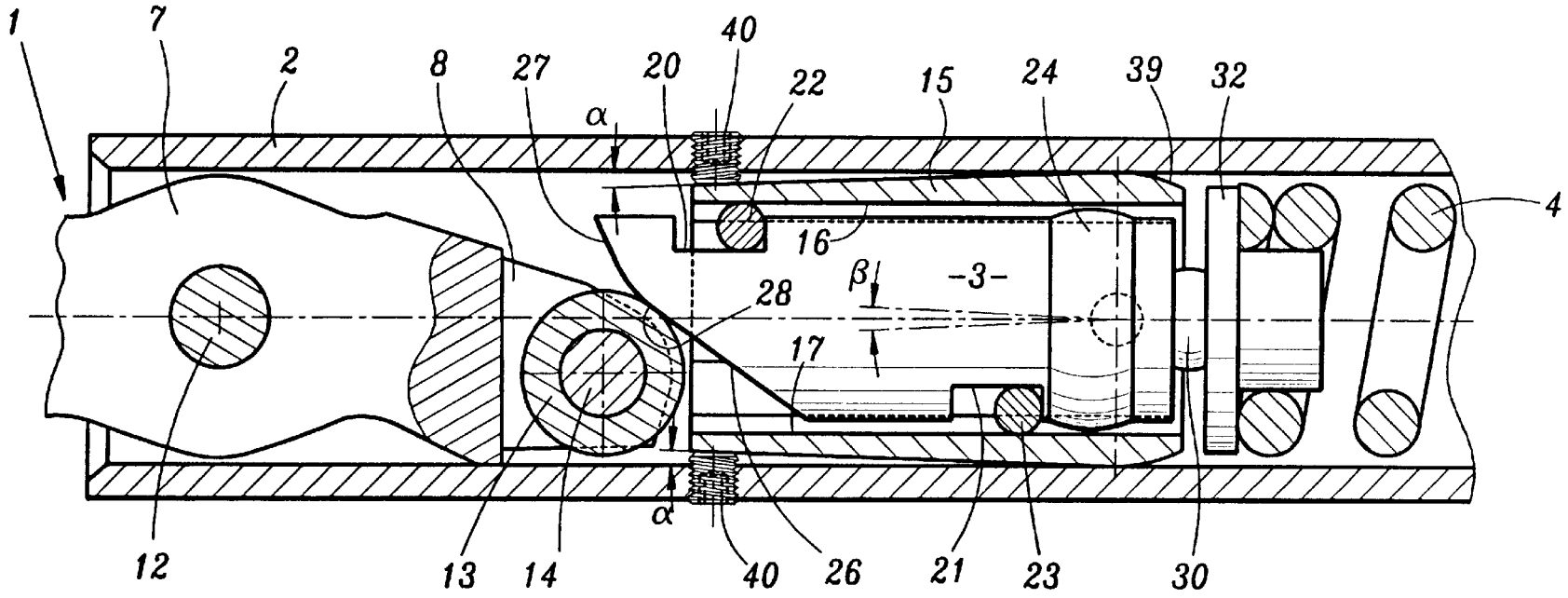
FIG. 10 is a view similar to FIG. 4 of another alternative form.

In the alternative form of FIG. 10, the outer surface of the slideway 15 converges forward at an angle $\alpha$ of a few degrees and at the back has a spherical region 39 which swivels within the body 2. Two diametrically opposed adjustment screws 40 with a common vertical axis pass through tapped orifices in the body 2 and come into contact with the outer surface of the front end of the slideway. The amounts by which they penetrate define the angular orientation $\beta$ of the axis of the slideway with respect to the axis X—X in the vertical mid-plane P.

This makes it possible, at the start, to adjust the slope of the ramps 26 and 27 and therefore makes initial calibration of the tool easier.

Figure 11:
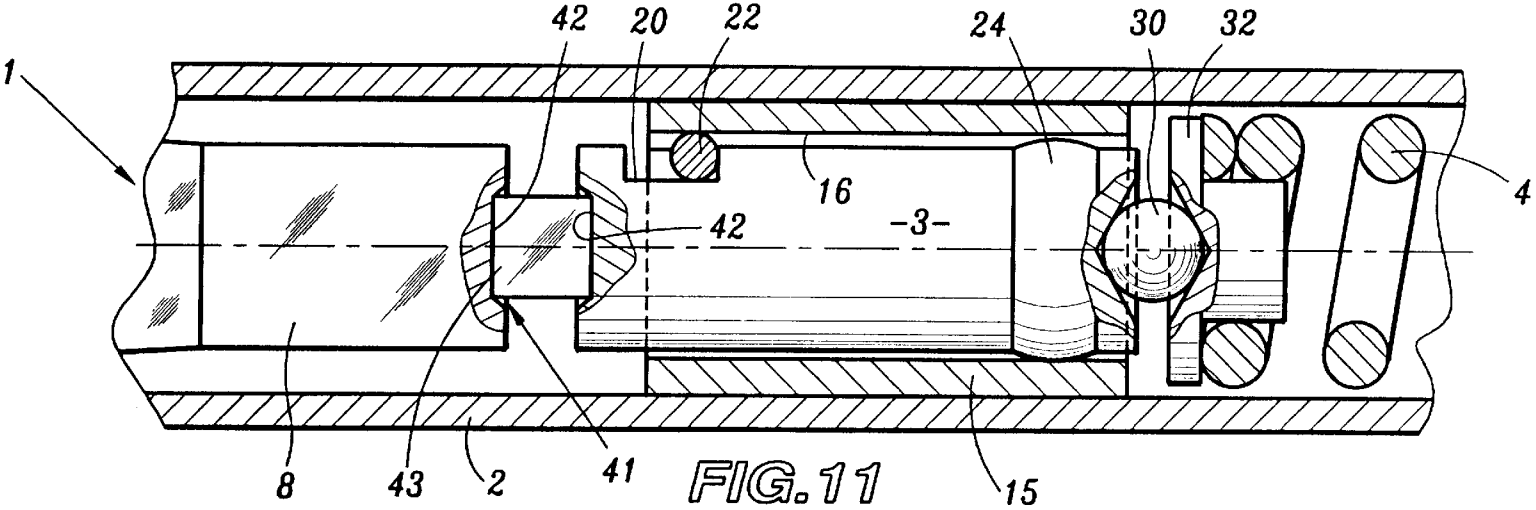
FIG. 11 is a view similar to FIG. 4 of another embodiment of the invention, constituting a disengaging-action wrench.
Figure 12:
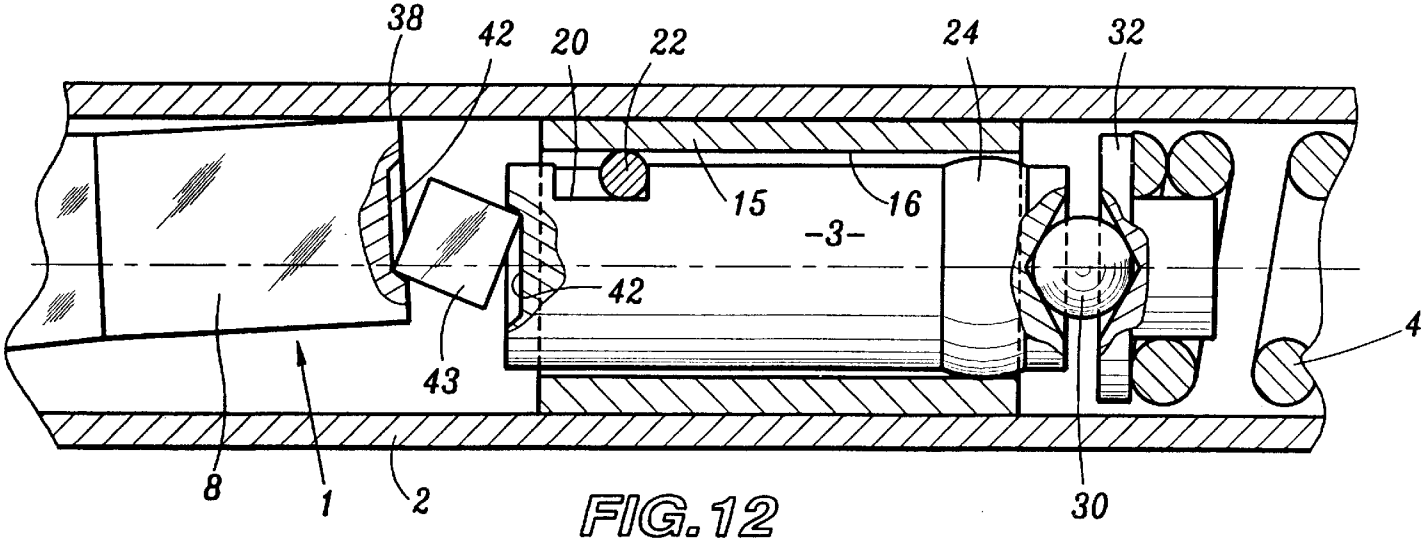
FIG. 12 is a view similar to FIG. 11, depicting the wrench after it has been disengaged.

The wrench depicted in FIGS. 11 and 12 differs from the one in FIGS. 1 to 5 in two respects.

On the one hand, this is a disengagement-type wrench of the cube type. Thus, the rear face of the shank 8 and the front face of the plunger are vertical faces facing one another, each of which has a frusto-conical recess 41 with a flat and vertical bottom 42.

A cube 43 lies, at rest, against the two bottoms 42 (FIG. 11). When the predetermined maximum torque is reached, the cube inclines, and the lengthening of the axial component of the diagonal which is the result of this causes the plunger to move back (FIG. 12) until the shank 8 comes into contact with the upper region of the body 2, at 38. As an alternative, the cube 43 could be replaced by a ball interacting with two conical recesses in the same way as the ball 30, or alternatively by any other known disengagement device.

On the other hand, we started out from the following premise: in the examples of FIGS. 1 to 10, the front roundel 22 experiences a high compression loading, but the same is not true of the rear roundel 23, which is only lightly loaded. It is therefore possible, at least in some instances, to replace the rear roundel with a contact which is more economical to produce, which here is a direct rubbing contact between the lower rear region of the plunger and slideway 15. This contact is advantageously provided by the spherical region 24 already used for the lateral guidance with self-alignment of the plunger.

We Claim:

1. A torque wrench, of the type comprising an outer body (2) of elongate shape in which the head (1) of the wrench is articulated about a pivot (12); a plunger (3) that can move axially in the outer body and is urged toward the head by a preloaded spring (4); at least a first rolling body (22) intended to reduce friction as the plunger moves, this rolling body comprising a peripheral surface which rolls along a first track (16) secured to the outer body and which is pressed against this first track when torque is applied; and a load-transmission member (13; 43) inserted between a front end of the plunger and a rear end of the head, wherein the rolling body (22) is a cylindrical roundel whose peripheral surface also rolls along a second track (20) formed on the plunger (3), and in that each of the first and second tracks (16, 20) is flat.

2. The torque wrench as claimed in claim 1, wherein one of the first and second tracks (16) is delimited by side walls (116) which interact with end faces of the roundel (22), while the other track (20) is wider.

3. The torque wrench as claimed in claim 1, which comprises means (23; 24) providing direct or indirect contact between a component (15) secured to the outer body (2) and a region of the plunger (3) which is situated behind said second track (20) and at on opposite side thereof with respect to a longitudinal axis (X—X) of the outer body.

4. The torque wrench as claimed in claim 3, wherein said contact means comprises a second rolling body (23), especially one similar to said first rolling body (22).

5. The torque wrench as claimed in claim 3, wherein said contact means comprises a domed surface (24) secured to the plunger (3).

6. The torque wrench as claimed in claim 1, wherein the plunger (3) at its front end comprises two successive cam ramps (26, 27) having two different slopes, which ramps are connected by a rounded portion (28) or by a sharp edge (128), and wherein the load-transmission member (13) rolls along these ramps.

7. The torque wrench as claimed in claim 6, wherein the load-transmission member (13) and the ramps (27, 28) have matching generatrices, and wherein the plunger (3) is mounted with freedom of movement that allows it, to self-align with the load-transmission member (13).

8. The torque wrench as claimed in claim 1, wherein the load-transmission member is a cube (43) or a ball which interacts with opposing recesses (41) in the plunger (3) and in the head (1).

9. The torque wrench as claimed in claim 1, wherein said first track (16) is formed in a slideway (15) attached inside the outer body (2).

10. The torque wrench as claimed in claim 9, wherein the orientation of the slideway (15) with respect to a longitudinal axis (X—X) of the outer body (2) is adjustable.

11. The torque wrench as claimed in claim 10, wherein the slideway (15) has a tubular overall shape and has a convergent outer surface with, at one end of this surface, a ball-joint-like shape (39) and, at the opposite end of this surface, an inclination-adjusting mechanism.

* * * * *